US009683275B2

(12) United States Patent
Zhang et al.

(10) Patent No.: US 9,683,275 B2
(45) Date of Patent: Jun. 20, 2017

(54) STEEL PLATE WITH LOW YIELD-TENSILE RATIO AND HIGH TOUGHNESS AND METHOD OF MANUFACTURING THE SAME

(75) Inventors: Aiwen Zhang, Shanghai (CN); Sihai Jiao, Shanghai (CN); Xiangqian Yuan, Shanghai (CN); Yushan Chen, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 455 days.

(21) Appl. No.: 14/129,052

(22) PCT Filed: May 25, 2012

(86) PCT No.: PCT/CN2012/076049

§ 371 (c)(1),
(2), (4) Date: Dec. 23, 2013

(87) PCT Pub. No.: WO2013/044640

PCT Pub. Date: Apr. 4, 2013

(65) Prior Publication Data

US 2014/0144556 A1 May 29, 2014

(30) Foreign Application Priority Data

Sep. 26, 2011 (CN) ..... 2011 1 0287965

(51) Int. Cl.
*C21D 8/02* (2006.01)
*C22C 38/50* (2006.01)
(Continued)

(52) U.S. Cl.
CPC ..... *C21D 8/0263* (2013.01); *C21D 6/005* (2013.01); *C21D 8/02* (2013.01); *C21D 9/46* (2013.01); *C22C 38/001* (2013.01); *C22C 38/002* (2013.01); *C22C 38/02* (2013.01); *C22C 38/06* (2013.01); *C22C 38/22* (2013.01); *C22C 38/26* (2013.01); *C22C 38/28* (2013.01); *C22C 38/38* (2013.01); *C22C 38/44* (2013.01);
(Continued)

(58) Field of Classification Search
CPC ..... C21D 8/02; C21D 8/0263
USPC ..... 148/334, 335, 541, 547
See application file for complete search history.

(56) References Cited

U.S. PATENT DOCUMENTS

2012/0031528 A1 2/2012 Hayashi et al.

FOREIGN PATENT DOCUMENTS

CN 1840723 A 10/2006
CN 1840724 A 10/2006
(Continued)

OTHER PUBLICATIONS

International Search Report from PCT/CN2012/076049, dated Sep. 20, 2012 (English version only).

*Primary Examiner* — Brian Walck
(74) *Attorney, Agent, or Firm* — Kilpatrick Townsend & Stockton LLP

(57) ABSTRACT

A steel plate with a low yield ratio and high toughness. The steel plate comprises components of, by weight: C (0.05-0.08%), Si (0.15-0.30%), Mn (1.55-1.85%), P (less than or equal to 0.015%), S (less than or equal to 0.005%), Al (0.015-0.04%), Nb (0.015-0.025%), Ti (0.01-0.02%), Cr (0.20-0.40%), Mo (0.18-0.30%), N (less than or equal to 0.006%), O (less than or equal to 0.004%), Ca (0.0015-0.0050%), and Ni (less than or equal to 0.40%), a ratio of Ca to S being greater than or equal to 1.5, and the residual being Fe and inevitable impurities.

16 Claims, 1 Drawing Sheet

(51) Int. Cl.

| | |
|---|---|
| ***C21D 6/00*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/38*** | (2006.01) |
| ***C22C 38/44*** | (2006.01) |
| ***C22C 38/48*** | (2006.01) |
| ***C22C 38/58*** | (2006.01) |

(52) U.S. Cl.
CPC ..... *C22C 38/48* (2013.01); *C22C 38/50* (2013.01); *C22C 38/58* (2013.01)

(56) References Cited

FOREIGN PATENT DOCUMENTS

| | | | |
|---|---|---|---|
| CN | 101649420 | A | 2/2010 |
| CN | 101985725 | A | 3/2011 |
| CN | 102021494 | A | 4/2011 |
| JP | S57134514 | A | 8/1982 |
| JP | 04-285119 | A | 10/1992 |
| JP | H1180832 | A | 3/1999 |
| JP | 2005-036295 | A | 2/2005 |
| JP | 2009-235524 | A | 10/2009 |
| JP | 2010236046 | A | 10/2010 |
| JP | 2011-052293 | A | 3/2011 |
| JP | 2011-074443 | A | 4/2011 |
| JP | 2011-140672 | A | 6/2011 |
| WO | 9905335 | A1 | 2/1999 |
| WO | 0039352 | A2 | 7/2000 |
| WO | 2009/048838 | A1 | 4/2009 |
| WO | 2010074473 | A2 | 7/2010 |
| WO | 2010/137317 | A1 | 12/2010 |

STEEL PLATE WITH LOW YIELD-TENSILE RATIO AND HIGH TOUGHNESS AND METHOD OF MANUFACTURING THE SAME

FIELD OF THE INVENTION

The present invention relates to a hot-rolled steel plate with high toughness and a method of manufacturing the same, in particular to a steel plate with yield strength of 500 MPa, low yield-tensile ratio and high toughness and a method of manufacturing the same. The steel plate of the present invention has a low yield-tensile ratio, and transportation pipelines made of them can resist large deformation and are adapted to high-activity seismic areas.

BACKGROUND OF THE INVENTION

Usually, traditional oil and gas pipelines are made by Nb alloying and controlled rolling, which results in that the yield-tensile ratio of pipeline steel is relatively high, normally, greater than or equal to 0.85, thus, this type of pipeline steel is not adapted to manufacture transportation pipelines used in high-activity seismic areas.

CN101962733A discloses an X80 high-deformability pipeline steel with low cost and high toughness and the manufacturing method thereof, wherein C: 0.02-0.08%, Si≤0.40%, Mn: 1.2-2.0%. P≤0.015%, S≤0.004%, Cu≤0.40%, Ni≤0.30%, Mo: 0.10-0.30%, Nb: 0.03-0.08%, Ti: 0.005-0.03%, and the technology thereof is adopted that the soaking temperature is 1200-1250° C., the rolling finishing temperature of the recrystallization zone is 1000-1050° C., the rolling starting temperature for finish rolling is 880-950° C., and the rolling finishing temperature thereof is 780-850° C.; the steel is air-cooled by two stages at speed of 1-3° C./s to the temperate which is 20-80° C. below $Ar_3$, thereby obtaining 20-40% ferrite; laminar cooled at speed of 15-30° C./s to 250-450° C., obtaining steel plate with ferrite (20-40%)+bainite+martensite (1-3%) whose yield strength is 530-630 MPa, tensile strength is 660-800 MPa, uEL is ≥10%, and the yield-tensile ratio is ≤0.80. The properties such as yield-tensile ratio and elongation of the steel plate cannot yet meet the requirements on resistance to large deformation of the transportation pipelines used in high-activity seismic areas.

Therefore, currently a steel plate with low yield-tensile ratio and high toughness is needed for manufacturing transportation pipelines used in high-activity seismic areas which can resist large deformation.

SUMMARY OF THE INVENTION

The objective of the present, invention is to provide a pipeline steel plate with yield strength of above 500 MPa, low yield-tensile ratio and high toughness, particularly to provide a steel plate having a thickness of 10-25 mm. The type of steel plate is appropriate for making steel pipes acting as high-deformability transportation pipelines among high-activity seismic areas.

To achieve the aforementioned objective, the steel plate of the present invention contains the following chemical compositions, by weight, C: 0.05-0.08%, Si: 0.15-0.30%, Mn: 1.55-1.85%, P≤0.015%, S≤0.005%, Al: 0.015-0.04%, Nb: 0.015-0.025%, Ti: 0.01-0.02%, Cr: 0.20-0.40%, Mo: 0.18-0.30%, N: ≤0.006%, O≤0.004%, Ca: 0.0015-0.0050%, Ni≤0.40%, wherein, the ratio Ca/S is ≥1.5, other compositions being Ferrum and unavoidable impurities.

Preferably, Si is 0.16-0.29% by weight.

Preferably, Mn is 1.55-1.83% by weight.

Preferably, N is ≤0.0055% by weight, and preferably, 0.003-0.0045% by weight.

Preferably, P is ≤0.008% by weight, and S is ≤0.003% by weight.

Preferably, Al is 0.02-0.035% by weight.

Preferably, Ni is ≤0.25% by weight.

Preferably, Cr is 0.24-0.36% by weight.

Preferably, Mo is 0.19-0.26% by weight.

Preferably, Nb is 0.018-0.024% by weight.

Preferably, Ti is 0.012-0.019% by weight.

Preferably, Ca is 0.0030-0.0045% by weight.

In the present invention, unless otherwise specified, the content herein always indicates the percentage by weight.

Structures of the steel plate in the present invention include predominantly, ferrite, tempered bainite and possible few martensite.

Another objective of the present invention is to provide a steel pipe made of the above steel plate with low yield-tensile ratio and high toughness.

Yet another objective of the present invention is to provide a method of manufacturing such a medium steel plate with yield strength of above 500 MPa, low yield-tensile ratio and high toughness.

The manufacturing method of the aforementioned pipeline steel plate with low yield-tensile ratio and high toughness may include the following steps:

after vacuum degassing treatment, continuous-casting or die-casting molten steel, and if the molten steel is die-casted, blooming it into a billet;

heating the continuous casting slab or billet at temperature of 1150-1220° C., then multi-pass rolling it in austenite recrystallization zone and non-recrystallization zone, with the total reduction ratio being ≥80% and the rolling finishing temperature being ≥850° C.;

water-cooling rapidly the rolled steel plate at speed of 15-50° C./s to the temperature range from Bs−60° C. to Bs−100° C., then air-cooling it for 5-60 s;

after the cooled steel plate entering an online induction heating furnace, rapidly heating it at speed of 1-10° C./s to Bs+20° C., tempering it for 40-60 s, then air-cooling it outside the furnace.

According to the present invention, the starting point Bs of bainite is calculated by the following expression:

$$Bs=830-270C-90Mn-37Ni-70Cr-83Mo.$$

Preferably, in the multi-pass rolling, the reduction ratio in austenite recrystallization zone is ≥65%, and in non-recrystallization zone, it is ≤63%.

Preferably, the rolling finishing temperature is 850-880° C., and more preferably, 850-860° C.

Preferably, the rolled steel plate is rapidly water-cooled at speed of 15-50° C./s to 510-550° C., and more preferably, to 515-540° C.

In the present invention, by using the appropriate component design, heating, rolling, rapid cooling, online rapid heating and short-time tempering process, the objective of obtaining a pipeline steel plate with low yield-tensile ratio and high toughness which includes structures of ferrite, tempered bainite, and possible few marensite, can be achieved. The steel plate with a thickness of 10-25 mm has a yield strength of ≥500 MPa a yield-tensile ratio of ≤0.75, an elongation $A_{50}$ of ≥20%, $A_{kv}$ at −60° C. of ≥200 J and good cool bending property, which meets the high demand for high-deformability pipeline steel plate. The steel plate with low yield-tensile ratio and high toughness in the present invention is appropriate for steel pipes acting as high-deformability transportation pipelines, particularly for those transportation pipelines in high-activity seismic areas.

DETAILED DESCRIPTION OF THE INVENTION

Figure 1:
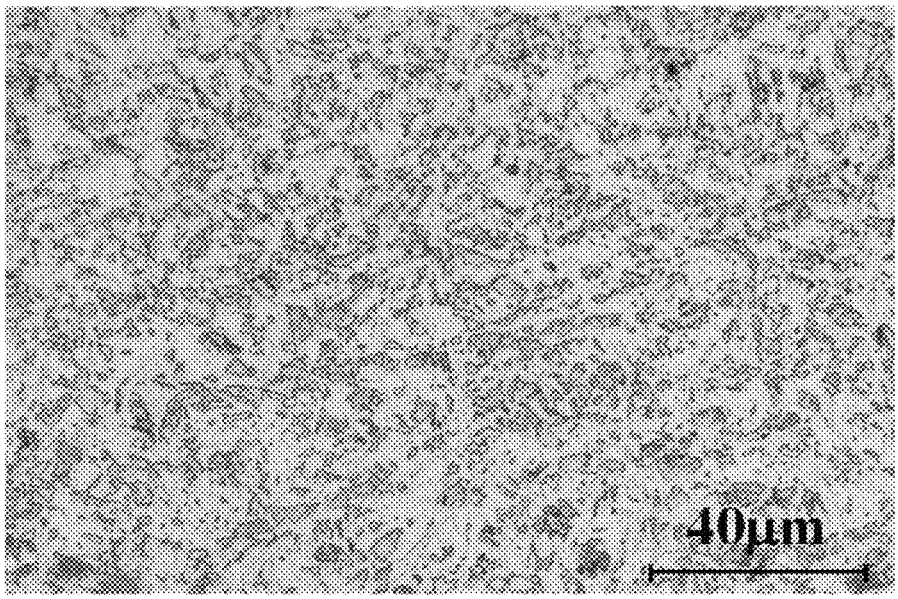
FIG. 1 is a typical metallographic structure photo of a steel plate with a thickness of 10 mm of the embodiment 1 according to the present invention.

Hereinafter, the features and properties of the present invention will be described in details in conjunction with the embodiments.

To achieve the objective of the present invention and provide a pipeline steel plate with yield strength of above 500 MPa, low yield-tensile ratio and high toughness, the chemical components of the steel plate may be controlled as follows.

Carbon: carbon is the key element to guarantee the strength of steel plate. Usually, the content of carbon in pipeline steel is less than 0.11%. Carbon improves the strength of steel plate via, solid solution strengthening and precipitation hardening, but it harms evidently toughness, ductility and weldability thereof, thus the development of pipeline steel is always accompanied by the reduction of carbon content. For the pipeline steel with high requirement on toughness, the carbon content usually is less than 0.08%. In the present invention, the carbon content is relatively low, that is, 0.05-0.08%.

Silicon: addition of silicon in steel can improve the purity and deoxygenation of steel. Silicon in steel contributes to solid solution strengthening, but excessive silicon may cause that when the steel plate is heated, the oxide skin thereof may become highly viscous, and it is difficult to descale after the steel plate exiting from furnace, thereby resulting in a lot of red oxide skins on the steel plate after rolling, i.e. the surface quality is bad; besides, the excessive silicon may also be harmful to the weldability of steel plate. In consideration of all the factors above, the content of silicon in the present invention is 0.15-0.30%, preferably 0.16-0.29%.

Manganess: increasing the content of manganess is the most inexpensive and immediate way to compensate for the strength loss caused by the reduction of carbon content. But manganess has a high segregation tendency, so its content should not be very high, generally, no more than 2.0% in low-carbon microalloyed steel. The amount of manganess added depends mostly on the strength level of the steel. The manganess content in the present invention should be controlled within 1.55-1.85%, preferably, 1.55-1.83%.

Nitrogen: nitrogen in pipeline steel is mainly combined with niobium into niobium nitride or niobium carbonitride for precipitation strengthening. During rolling, to make sure that niobium works well on inhibiting recrystallization, it is hoped that niobium as solid solute, is capable of inhibiting recrystallization, whereby it is required not to add excessive nitride in pipeline steel, such that most niobium carbonitride in billet can be dissolved at the conventional heating temperature (about 1200° C.). Generally, the nitride content in pipeline is no more than 60 ppm, preferably, no more than 0.0055%, more preferably, 0.003-0.0045%.

Sulphur and Phosphorus: in steel, sulphur, manganess and the like are combined into a plastic inclusion, that is, manganese sulfide, which is harmful to the transverse ductility and toughness thereof, thus the sulphur content should be as low as possible. The element, phosphorus, is also one of the harmful elements, which seriously impairs the ductility and toughness of steel plates. In the present invention, both sulphur and phosphorus are unavoidable impurity elements that should be as few as possible. In view of the actual steelmaking conditions, the present invention requires that P is ≤0.015%, S is ≤0.005%, preferably, P is ≤0.008%, S is ≤0.003%.

Aluminum: in the present invention, aluminum acts as the strong deoxidization element. To ensure the oxygen content as low as possible, the aluminum content should be controlled within 0.015-0.04%. After deoxidization, the remaining aluminum is combined with nitrogen in steel to form AlN precipitation which can improve the strength and during heat treatment, refine the austenitic grains therein. Preferably, the content of Al is 0.02-0.035%.

Niobium: niobium can significantly increase the recrystallization temperature of steel, and refine crystalline grains therein. During hot rolling process, carbide of niobium, owing to strain-induced precipitation, may restrict the recovery and recrystallization of deformed austenite, and through control rolling and control cooling, the deformed austenite may become fine phase-change products. Generally, the modern pipeline steel has more than 0.02% of niobium and TMCP pipeline steel is of high yield-tensile ratio and anisotropy. The present invention uses low content of niobium to obtain high-deformability pipeline steel with low yield-tensile ratio, while the strength loss caused by the reduction of niobium is compensated by Mn, Cr, Mo. Furthermore, the effect of precipitation strengthening is increased by precipitating fine dispersed carbides during rapid cooling and online rapid tempering process. Thus, the niobium content in the present invention should be controlled within 0.015-0.025%, preferably, within 0.018-0.024%.

Titanium: titanium is one of strong carbide-forming elements. The addition of trace Ti in steel is good for stabilizing N, and TiN formed can also make austenitic gains of billets, during being heated, not coarsening too much, whereas refining the original austenitic grains. In steel, titanium may be combined with carbon and sulphur respectively and formed into TiC, TiS, $Ti_4C_2S_2$ and the like, which exist in the ferns of inclusion and second-phase particles. When welding, these carbonitride precipitations of titanium are also capable of preventing the growth of grains in heat-affected zone, thereby improving the welding performance. In the present invention, the titanium content is controlled within 0.01-0.02%, preferably, within 0.012-0.019%.

Chromium: chromium promotes hardenability and tempering resistance of steel. Chromium exhibits good solubility in austenite and can stabilize the austenite. After quenching, much of it solubilizes in martensite and subsequently precipitates carbides such as $Cr_{23}C_7$, $Cr_7C_3$ in tempering process, which improves the strength and hardness of steel. For keeping the strength level of steel, chromium can replace manganess partly and reduce the segregation tendency thereof. Combining with the fine carbides precipitated via online rapid induction heat tempering, it can reduce the content of Nb alloy. Accordingly, in the present invention, 0.20-0.40%, preferably 0.24-0.36% of chromium may be added.

Molybdenum: molybdenum can significantly refine grains, and improve the strength and toughness of steel. It reduces tempering brittleness of steel while precipitating very fine carbides during tempering, which can strengthen the matrix thereof. Because molybdenum is a kind of strategic alloying element which is very expensive, in the present invention only 0.18-0.30%, preferably 0.19-0.26% of molybdenum is added.

Nickel: nickel is used to stabilize the austenite elements, with no remarkable effect on improving strength. Addition of nickel in steel, particularly in quenched and tempered steel, can promote toughness, particularly low-temperature toughness thereof, while it is also an expensive alloying element, so the present invention has, optionally, no more than 0.40%, preferably no more than 0.25% of nickel element.

Calcium: calcium treatment in the pipeline steel of the present invention, is to change the form of the sulfides, thereby improving the performance of the steel in thickness and transverse direction, and cold bending property. For steel with very low sulfur, calcium treatment may be not necessary. In the present invention, the content of calcium is dependent on that of sulfur, and the ratio Ca/S should be controlled as ≥1.5, wherein the content of Ca is 0.0015-0.0050%, more preferably, 0.0030-0.0045%.

The aforementioned pipeline steel plate with low yield-tensile ratio and high toughness is manufactured according to the following process:

Bessemerizing and Vacuum Treatment: its aim is to ensure that molten steel contains basic components, remove harmful gases such as oxygen, hydrogen therein, and add necessary alloy elements such as manganese, titanium, so as to adjust them.

Continuous Casting or Die Casting: its aim is to ensure that the blank has homogeneous inner components and good surface quality, wherein static ingots formed by die casting need to be rolled into billets;

Heating and Rolling: heating the continuous casting slab or billet at temperature of 1150-1220° C. to, on one hand, obtain uniform austenite structure, and on the other hand, dissolve partly the compounds of alloying elements like niobium, titanium, chromium, molybdenum. Multi-pass rolling it in austenite recrystallization zone and non-recrystallization zone, wherein in austenite recrystallization zone the reduction ratio is ≥65%, and in non-recrystallization zone, it is ≤63%, with the total reduction ratio being ≥80%, the rolling finishing temperature is ≥850° C., and more preferably, 850-880° C.;

Rapid Cooling: rapidly water-cooling the rolled steel plate at speed of 15-50° C./s to the temperature range from Bs−60° C. to Bs−100° C. and air-cooling it for 5-60 s; during the rapid cooling, most alloying elements are solved into martensite;

Online Tempering: after the cooled steel plate entering an online induction heating furnace, heating it rapidly at speed of 1-10° C./s to Bs+20° C., and tempering it for 40-60 s, then air-cooling it outside the furnace. The tempering helps to eliminate the internal stress produced in steel plate during rapid cooling and the microcracks in or between bainite strips, and precipitate dispersively carbides to strengthen, therefore improving the ductility, toughness and cool bending property thereof.

Super fast cooling and online rapid tempering process can reduce effectively the yield-tensile ratio and anisotropy of pipeline steel. In addition to shortening the process time and saving energy, online heat treatment (tempering) process can, more importantly, improve fully the performance of the steel plate manufactured previously by TMCP, and particularly solve the problem that microalloying steel has too high anisotropy and yield-tensile ratio resulted from non-recrystallization rolling, thereby creating conditions for producing pipeline steel with resistance to large deformation, high strength steel for buildings with low yield-tensile ratio, and steel plates with high requirements.

Through controlling the cooling temperature within a certain range, online rapid induction heating, tempering for a short time, and choosing suitable temperature, the present invention controls precisely the structure of steel plates, thereby obtaining relatively low yield-tensile ratio; moreover, via the precipitation of diffusely fine carbides inside steel plate, the strength and toughness thereof can match well.

In the present invention, by using the appropriate component design, heating, rolling, rapid cooling, online rapid heating and short-time tempering process, the objective of obtaining a pipeline steel plate with low yield-tensile ratio and high toughness which includes structures of ferrite (F), bainite (B), and possible few marensite (MA), can be achieved. The steel plate with a thickness of 10-25 mm has a yield strength of ≥500 MPa, a yield-tensile ratio of ≤0.75, an elongation $A_{50}$ of ≥20%, $A_{kv}$ at −60° C. of ≥200 J and good cool bending property, which meets the high demand for high-deformability pipeline steel plate.

EMBODIMENTS

Embodiment 1

Molten steel smelt in accordance with the matching ratio of table 1, after vacuum matching degassing, is continuously casted or die casted, obtaining a slab of 80 mm thick. The slab is heated at 1200° C., and multi-pass rolled at the austenite recrystallization temperature range into steel plate with a thickness of 10 mm, wherein the total reduction rate is 88%, rolling finishing temperature is 860° C.; then it is cooled to 535° C. at speed of 35° C./s, rapidly heated online to 640° C. and tempered, after which the steel plate is air-cooled to ambient temperature.

Table 1 shows the detailed components in embodiments 2-5, of which the process is similar to embodiment 1. The processing parameters thereof are described in Table 2.

TABLE 1

Chemical Components, Ceq (wt %) and Pcm in Embodiments 1-5 of The Present invention

| Embodiments | C | Si | Mn | P | S | Al | Ni | Cr | Mo | Nb | Ti | Ca | N | Ceq* | Pcm** |
|---|---|---|---|---|---|---|---|---|---|---|---|---|---|---|---|
| 1 | 0.050 | 0.25 | 1.75 | 0.007 | 0.003 | 0.025 | | 0.3 | 0.21 | 0.021 | 0.015 | 0.0049 | 0.0036 | 0.44 | 0.17 |
| 2 | 0.053 | 0.28 | 1.62 | 0.008 | 0.003 | 0.031 | | 0.32 | 0.23 | 0.02 | 0.014 | 0.0048 | 0.0038 | 0.43 | 0.17 |
| 3 | 0.062 | 0.25 | 1.75 | 0.007 | 0.002 | 0.021 | | 0.35 | 0.19 | 0.023 | 0.018 | 0.0031 | 0.0037 | 0.46 | 0.19 |
| 4 | 0.074 | 0.26 | 1.81 | 0.008 | 0.003 | 0.034 | 0.25 | 0.31 | 0.25 | 0.02 | 0.016 | 0.0045 | 0.0034 | 0.51 | 0.21 |
| 5 | 0.080 | 0.16 | 1.55 | 0.007 | 0.002 | 0.028 | 0.22 | 0.25 | 0.22 | 0.018 | 0.013 | 0.0032 | 0.004 | 0.45 | 0.19 |

*Ceq = C + Mn/6 + (Cr + Mo + V)/5(Ni + Cu)/14;

**Pcm = C + Si/30 + Mn/20 + Cu/20 + Ni/60 + Cr/20 + Mo/15 + V/10 + 5B.

TABLE 2

Processing Parameters And Steel Plate Thickness in Embodiments 1-5 of The Present Invention

| Embodiments | Heating Temperature/° C. | Rolling finishing Temperature/° C. | Reduction Rate/% | Cooling Speed/° C./s | Final Cooling Temperature/° C. | Tempering Temperature/° C. | Tempering Time/s | Thickness/mm |
|---|---|---|---|---|---|---|---|---|
| 1 | 1150 | 860 | 88 | 35 | 535 | 640 | 45 | 10 |
| 2 | 1150 | 850 | 80 | 25 | 540 | 640 | 50 | 15 |
| 3 | 1200 | 850 | 80 | 25 | 530 | 625 | 50 | 15 |
| 4 | 1200 | 850 | 75 | 20 | 515 | 615 | 55 | 20 |
| 5 | 1220 | 850 | 70 | 15 | 540 | 640 | 60 | 25 |

Test 1: Mechanical Property

According to GB/T228-2002 Metallic materials—Tensile testing at ambient temperature, GB 2106-1980 Metallic materials—Charpy notch impact test. GB/T 8363-2007 Test method for drop-weight tear tests of steel products, each mechanical property of steel plate in embodiments 1-5 in the present invention is measured and the result thereof is shown in Table 3.

TABLE 3

Mechanical Property of Steel Plate in Embodiments of The Present Invention

| Embodiments | $Rt_{0.5}$/MPa | Rm/MPa | Yield-tensile ratio | $A_{50}$/% | $E_{cvn-60° C.}$ Impact Value/J | SA % | 50% FATT | SA $\%_{-15° C.}$ DWTT |
|---|---|---|---|---|---|---|---|---|
| 1 | 535 | 760 | 0.70 | 21 | 211 | 100 | <−60° C. | 100 |
| 2 | 553 | 785 | 0.71 | 24.8 | 240 | 100 | <−60° C. | 100 |
| 3 | 580 | 795 | 0.73 | 26 | 235 | 100 | <−60° C. | 100 |
| 4 | 583 | 800 | 0.73 | 25.8 | 205 | 100 | <−60° C. | 100 |
| 5 | 575 | 805 | 0.71 | 28 | 221 | 100 | <−60° C. | 100 |

Wherein, $E_{cvn-60° C.}$: Charpy V-notch impact energy at −60° C.;

SA $\%_{-15° C.}$: DWTT shear fracture area of fracture sample at −15° C.;

DWTT: drop-weight tear test;

50% FATT: 50% Fracture Appearance Transition Temperature;

Test 2: Bending Property

According to GB/T 232-2010 Metallic materials—Bend test, the steel plates in embodiments 1-5 are cold-bent transversely for d=2a, 180°, with the result being that all the steel plates are complete, without any surface crack.

Test 3: Metallographic Structure

FIG. 1 is the schematic view of the metallographic structure of the steel plate with a thickness of 10 mm in embodiment 1 according to the present invention.

Figure 2:
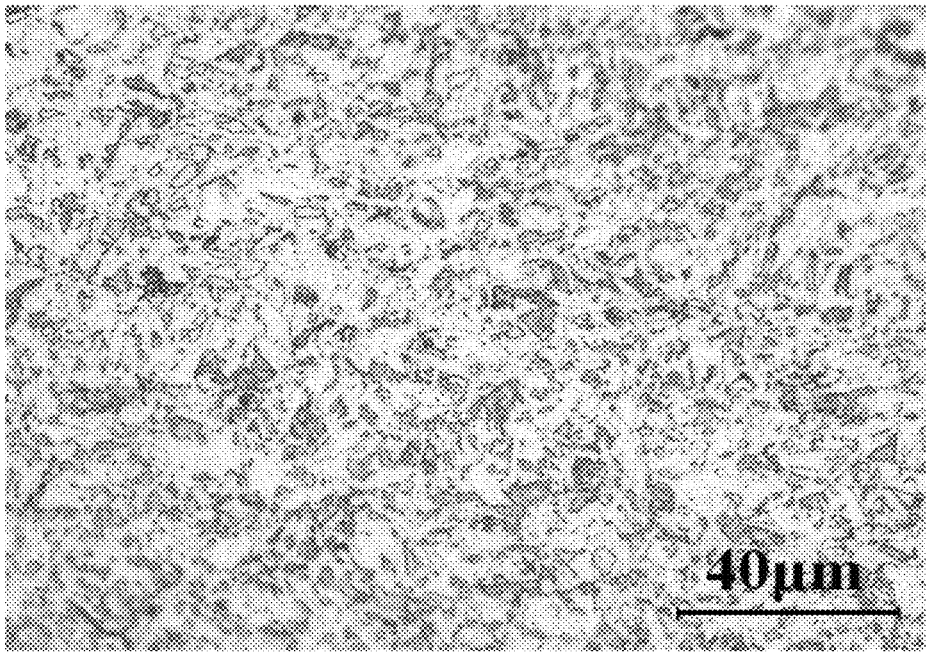
FIG. 2 is a typical metallographic structure photo of a steel plate with a thickness of 25 mm of the embodiment 5 according to the present invention.

FIG. 2 is the schematic view of the metallographic structure of the steel plate with a thickness of 25 mm in embodiment 5 according to the present invention.

From the figures, it is known that the structures of steel plate include ferrite, tempered bainite and a few martensite.

Similar metallographic structure views can be gained from other embodiments.

From the above embodiments, we can brow that by using the component design, heating, rolling, rapid cooling and online rapid heat tempering process, the steel plate is fine-grain, phase-change, and precipitation strengthened, and improved on the strength and hardness. It also features high low-temperature toughness, and particularly low yield-tensile ratio, the structures of which appear to be ferrite, tempered bainite, and possible few martensite and dispersed carbides. The steel plate with a thickness of 10-25 mm has a longitudinal and transverse yield strength of ≥500 MPa, a yield-tensile ratio of ≤0.75, an elongation $A_{50}$ of ≥20%, $A_{kv}$ at −60° C. of ≥200 J and good cool bending property, which meets the high demand of high-deformability transportation pipeline steel. Additionally, seen from Table 1, both Ceq and Pcm of the steel is relatively low, which indicates that the steel plate in the present invention has good weldability and resistance to crack sensitivity.

The invention claimed is:

1. A manufacturing method of a steel plate with low yield-tensile ratio and high toughness, comprising the following chemical compositions by weight, C: 0.05-0.08%, Si: 0.15-0.30%, Mn: 1.55-1.85%, P≤0.015%, S≤0.005%, Al: 0.015-0.04%, Nb: 0.015-0.025%, Ti: 0.01-0.02%, Cr: 0.20-0.40%, Mo: 0.18-0.30%, N:≤0.006%, O≤0.004%, Ca: 0.0015-0.0050%, Ni≤0.40%, wherein the ratio of Ca/S is ≥1.5, other compositions being Ferrum and unavoidable impurities, and wherein the steel plate has a thickness of 10-25 mm, a yield strength of ≥500 MPa, a yield-tensile ratio of ≤0.75 an elongation $A_{50}$ of ≥20%, and an $A_{kv}$ at −60° C. of ≥200 J, wherein the method comprises:

a vacuum degassing treatment followed by either continuous-casting of molten steel into a continuous casting slab or die-casting of molten steel and blooming into a billet;

heating the continuous casting slab or billet at temperature of 1150-1220° C., then multi-pass rolling the continuous casting slab or billet in austenite recrystallization zone and non-recrystallization zone, with a total reduction ratio of ≥80% and a rolling finishing temperature of ≥850° C. to produce a rolled steel plate;

rapidly water-cooling the rolled steel plate at a rate of 15-50° C./s to a temperature range from Bs−60° C. to Bs−100° C., then air-cooling the rolled steel plate for 5-60 s; and entering the rolled steel plate into an online induction heating furnace, rapidly heating the rolled steel plate at a rate of 1-10° C./s to Bs+20° C., tempering the rolled steel plate for 40-60 s, then air-cooling the rolled steel plate outside the furnace;

wherein the starting point Bs of bainite is: Bs=830-270C-90Mn-37Ni-70Cr-83Mo.

2. The method according to claim 1, characterized in that during the multi-pass rolling, the reduction ratio in austenite recrystallization zone is ≥65%, and in non-recrystallization zone, it is ≤63%.

3. The method according to claim 1, characterized in that the rolling finishing temperature is 850-880° C.

4. The method according to claim 1, characterized in that the rolled steel plate is rapidly water-cooled at speed of 15-50° C./s to 510-550° C.

5. The method according to claim 1, characterized in that the Si in the steel plate is 0.16-0.29% by weight.

6. The method according to claim 1, characterized in that the Mn in the steel plate is 1.55-1.83% by weight.

7. The method according to claim 1, characterized in that the N in the steel plate is ≤0.0055% by weight, and preferably, 0.003-0.0045%.

8. The method according to claim 1, characterized in that the P in the steel plate is ≤0.008% by weight and the S in the steel plate is ≤0.003% by weight.

9. The method according to claim 1, characterized in that the Al in the steel plate is 0.02-0.035% by weight.

10. The method according to claim 1, characterized in that the Ni in the steel plate is ≤0.25% by weight.

11. The method according to claim 1, characterized in that the Cr in the steel plate is 0.24-0.36% by weight.

12. The method according to claim 1, characterized in that the Mo in the steel plate is 0.19-0.26% by weight.

13. The method according to claim 1, characterized in that the Nb in the steel plate is 0.018-0.024% by weight.

14. The method according to claim 1, characterized in that the Ti in the steel plate is 0.012-0.019% by weight.

15. The method according to claim 1, characterized in that the Ca in the steel plate is 0.0030-0.0045% by weight.

16. The method according to claim 1, characterized in that the steel plate has a structure including mainly ferrite, tempered bainite, and martensite.

* * * * *